US012606391B2

(12) United States Patent
Martinez et al.

(10) Patent No.: US 12,606,391 B2
(45) Date of Patent: Apr. 21, 2026

(54) SHEET PROCESSING MACHINE

(71) Applicant: BOBST MEX SA, Mex (CH)

(72) Inventors: Raúl Martinez, Cugy (CH); Paul Hornick, Vallorbe (CH)

(73) Assignee: BOBST MEX SA, Mex (CH)

( * ) Notice: Subject to any disclaimer, the term of this patent is extended or adjusted under 35 U.S.C. 154(b) by 0 days.

(21) Appl. No.: 18/853,532

(22) PCT Filed: Apr. 27, 2023

(86) PCT No.: PCT/EP2023/061139

§ 371 (c)(1),
(2) Date: Oct. 2, 2024

(87) PCT Pub. No.: WO2023/209106

PCT Pub. Date: Nov. 2, 2023

(65) Prior Publication Data

US 2025/0223124 A1 Jul. 10, 2025

(30) Foreign Application Priority Data

Apr. 29, 2022 (EP) ..... 22170784

(51) Int. Cl.
*B65H 1/06* (2006.01)
*B65H 3/08* (2006.01)
(Continued)

(52) U.S. Cl.
CPC ..... *B65H 1/06* (2013.01); *B65H 3/085* (2013.01); *B65H 3/122* (2013.01); *B65H 3/56* (2013.01);
(Continued)

(58) Field of Classification Search
CPC ..... B65H 1/06; B65H 3/122; B65H 2404/623
See application file for complete search history.

(56) References Cited

U.S. PATENT DOCUMENTS 3,871,642 A 3/1975 Mariaux et al.
4,009,876 A * 3/1977 Smiltneek ..... B65H 3/0891 271/99
(Continued)

FOREIGN PATENT DOCUMENTS

CN 1718523 A 1/2006
DE 10310696 A1 * 9/2004 ..... B65H 9/00
JP H04106050 A 4/1992

*Primary Examiner* — Patrick Cicchino
(74) *Attorney, Agent, or Firm* — Bookoff McAndrews, PLLC

(57) ABSTRACT

The invention discloses a sheet processing machine with an alignment plate at the input. The sheets are piled against the plate, and during each machine cycle, the bottommost sheet is extracted and delivered to a gripper bar of the machine. The alignment plate can move precisely longitudinally and diagonally to adjust the position and the skew of the sheet for correct positioning in the gripper bar. The alignment plate is guaranteed to be kept vertical by using a pair of synchronized linear actuators on each side of the plate. The machine can adapt to varying sheet thickness by adjusting the gap below that plate thanks to a motorized gauge. To even better position the sheets, a set of abutments is provided after the plate, and at a fixed distance to the plate. The abutments are pivoting to get out of the way of the gripper bar when needed.

15 Claims, 8 Drawing Sheets

Figure 1:
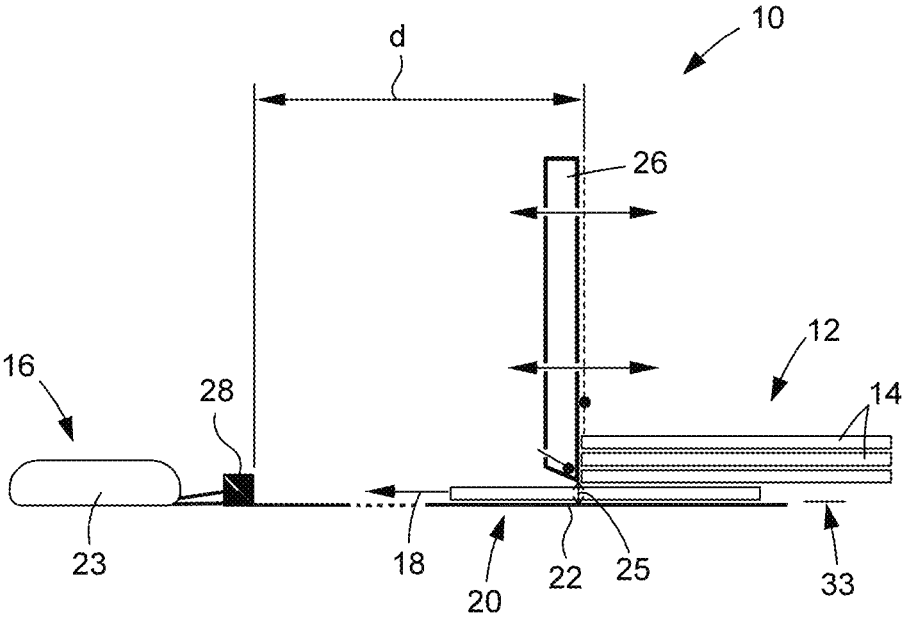

(51) Int. Cl.
*B65H 3/12* (2006.01)
*B65H 3/56* (2006.01)

(52) U.S. Cl.
CPC ..... *B65H 2301/42322* (2013.01); *B65H 2403/923* (2013.01); *B65H 2404/623* (2013.01)

(56) References Cited

U.S. PATENT DOCUMENTS 4,452,441 A * 6/1984 Poag ..... B65H 3/122 271/99
5,219,157 A * 6/1993 Takahashi ..... B65H 3/0692 271/118
6,244,592 B1 6/2001 Baba et al.
9,102,487 B2 * 8/2015 Tojima ..... B65H 3/46

* cited by examiner

SHEET PROCESSING MACHINE

CROSS-REFERENCE TO RELATED APPLICATION(S)

This application is a National Stage Application under 35 U.S.C. § 371 of International Application No. PCT/EP2023/061139, filed on Apr. 27, 2023, which claims priority to European Application No. 22170784.7, filed on Apr. 29, 2022, the entireties of which are incorporated herein by reference.

The present invention refers to a sheet processing machine for converting cardboard, such as a die-cutting, creasing and/or printing machine.

Sheet processing machines usually have a loading station in which cardboard sheets to be processed are piled prior to being transferred to a converting mechanism of the sheet processing machine.

In the loading station, the sheets are roughly aligned by an alignment plate, wherein the position of the alignment plate is adjustable to adapt the alignment of the sheets.

The sheets are extracted out of the loading station one by one and transferred to a transfer mechanism of the sheet processing machine. Before being transferred to the transfer mechanism, the sheets undergo an additional fine adjustment.

Further, a gauge is provided which is usually integrated into the alignment plate. The gauge ensures that only a single sheet at a time can be extracted from the loading station.

However, in the conventional sheet processing machines it may happen that the alignment plate is pivoted around a horizontal axis when adjusting the position of the alignment plate. This impedes the alignment of the sheets in the loading station, as the alignment plate no longer provides a consistent horizontal adjustment for the sheets. Further, by pivoting the alignment plate, the setting of the gauge is affected, as the distance of the gauge to a level of a support area of the sheets changes. Thus, it may happen that more than a single sheet at a time is extracted from the loading station.

It is thus on object of the present invention to provide a sheet processing machine in which the alignment and transfer of the sheets is improved.

This object is solved by a sheet processing machine comprising a transfer mechanism for moving sheets along a handling direction of the sheet processing machine, a loading station for supplying sheets to be processed, and an alignment plate adjoining the loading station for aligning sheets piled in the loading station. The alignment plate is moveable in the handling direction by means of at least two linear actuators which are arranged with a distance to each other with respect to a direction transverse to the handling direction. In particular, one actuator is arranged at or close to an operator side and the other actuator is arranged at or close to an opposite operator side. Further, a support mechanism is provided that prevents the alignment plate from pivoting around a horizontal axis.

The sheet processing machine according to the invention is improved with respect to fine adjustment and repeatability. In particular, no pivoting of the alignment plate around a horizontal axis is possible. Thus, no change of height of the lower edge of the alignment plate occurs and the position of the alignment plate is always upright. Positioning the sheets in the loading station by means of the alignment plate thus occurs particularly accurate. By operating the actuators independently from each other, the sheets in the loading station can be aligned with respect to skewing.

According to one embodiment, the alignment plate is moveable by means of two pairs of linear actuators, wherein the actuators of each pair of actuators are arranged vertically one above the other. In other words, the actuators are at the same position with regard to the longitudinal direction of the alignment plate, which is transvers to the handling direction of the sheet processing machine. A drive of the actuators is configured such that the actuators of each pair of actuators are driven synchronously.

By means of the two pairs of actuators i.e. four actuators unwanted tilting of the alignment plate around a vertical axis is effectively avoided. That means, according to one embodiment the support mechanism is implemented by providing the two pairs of synchronously driven actuators that are positioned in the above mentioned manner.

In an alternative embodiment, it is possible that the actuators of each pair of actuators are not arranged vertically one above the other. In this case, however, the actuators cannot be synchronously driven, but have to be driven with different turning rates, which makes the movement of the alignment plate more difficult to control.

In a further alternative embodiment, the support mechanism may be a guide that maintains the upright position of the alignment plate.

In a further alternative embodiment, the support mechanism may comprise further linear actuator that is arranged between the at least two actuators, in particular on a vertical center line of the alignment plate.

The actuators may comprise a threaded drive with a rotatable element and a rotatably fixed element which are in threaded engagement with each other. Thereby, a rotatable movement of the rotatable element can be translated into a linear movement in a simple manner.

The rotatably fixed element is fixed by means of two perpendicular axes, in particular to a machine frame. The axes allow a limited play of the rotatable fixed element to avoid over constraint of the actuator. In particular, a vertical axis provides a horizontal rotation freedom in the actuator to accommodate for the skewing angle of the alignment plate and allows a vertical play. A horizontal axis provides a transversal translation freedom.

In a further embodiment, the rotatably fixed element is fixed by means of a key and groove connection. A key and groove connection is rather simple in its design and thus provides a cost-efficient solution to rotatably fix the fixed element.

According to one aspect in which the alignment plate is moveable by means of two pairs of linear actuators, wherein the actuators of each pair of actuators are arranged vertically one above the other, each pair of actuators is driven by a single motor and the rotatable elements of each pair of actuators are linked by a belt drive or a chain drive. Thereby, the synchronization of the two actuators of a pair of actuators is achieved in a simple manner. In particular, the two actuators are mechanically linked by the belt drive or chain drive such that the actuators are driven with the same rotational speed. A further advantage is that by using a single motor to drive two actuators a compact and cost-efficient design of the sheet processing machine is achieved.

In an alternative embodiment in which the alignment plate is moveable by means of two pairs of linear actuators, wherein the actuators of each pair of actuators are arranged vertically one above the other, the rotatable element of each actuator is driven by a motor and the two motors assigned to a pair of actuators are synchronized. Thereby, a mechanical link between the actuators can be omitted.

By means of motors driving the actuators, the adjustment of the alignment plate can occur in an automated manner.

The alignment plate may comprise sliders at its lower end and may rest with the sliders on a supporting surface. Thereby, the weight of the alignment plate rests on the supporting surface, which may be arranged at a machine frame. Thus, the actuators do not need to carry the weight of the alignment plate and therefore do not need to be designed for heavy loads. In particular, the actuators only need to push and pull the alignment plate in a direction along the handling direction of the sheet processing machine. The supporting surfaces also define a fixed vertical position of the alignment plate.

For example, a travel distance of the alignment plate is limited. Thereby, the components which contribute to the adjustability of the alignment plate do not need to be designed for excessive travel of the alignment plate.

According to one embodiment, a limit switch sensor is provided, wherein the motor which drives the actuator may be stopped when the limit switch sensor detects a maximum travel of the alignment plate.

The alignment plate may be guided by at least one linear guide. The linear guide keeps the alignment plate laterally centered. Thereby, tilting of the alignment plate around a vertical axis is limited. In particular, it is avoided that a tilting angle of the alignment plate becomes too large such that the elements of the actuators could get wedged into each other.

According to one aspect, the sheet processing machine comprises an abutment element which is arranged after the alignment plate with respect to the handling direction for fine adjustment of a sheet and which may be formed at an edge of a tablet which is mounted at the alignment plate. The distance between alignment plate and the abutment element is fixed. The abutment element is parallel to the alignment plate at any time except when lowered. This embodiment is particularly advantageous because the abutment element is adjusted simultaneously with the alignment plate, that means that no separate drive is necessary for adjusting the abutment element.

The tablet is for example pivotably mounted to the alignment plate and the pivots are arranged below a table level on which the sheets are placed. Thereby, the tablet may be pivoted in such a way that the abutment element is lowered to clear the way for the sheet to pass the abutment element after the fine positioning.

The tablet may have the form of an L. Thereby, an abutment element with a fixed distance to the alignment plate can be realized in a simple manner. In particular, one leg of the L forms the abutment element and protrudes above the table level when the other leg is on the table level.

The alignment plate may comprise an integrated gauge plate that is height adjustable with respect to the alignment plate. The gauge allows setting the gap between the table level and the bottom of the alignment plate and thus allows it to adapt to several sheet thicknesses. The gauge plate can thus be adjusted in its height independently from the alignment plate. A height adjustment of the alignment plate is not necessary. Thereby, the structure of the sheet processing machine is simplified.

For example, the gauge plate is height adjustable with respect to the alignment plate by means of a further linear actuator. The gauge plate can thus be adjusted with sufficient accuracy.

An alternative to the gauge would be to adjust the height of the complete plate.

The sheet processing machine preferably comprises a handling mechanism configured to move a sheet from the sheets piled in the loading station to feed a sheet to the transfer mechanism. The feeding of sheets to the transfer mechanism can thus occur in an automated manner.

Figure 2:
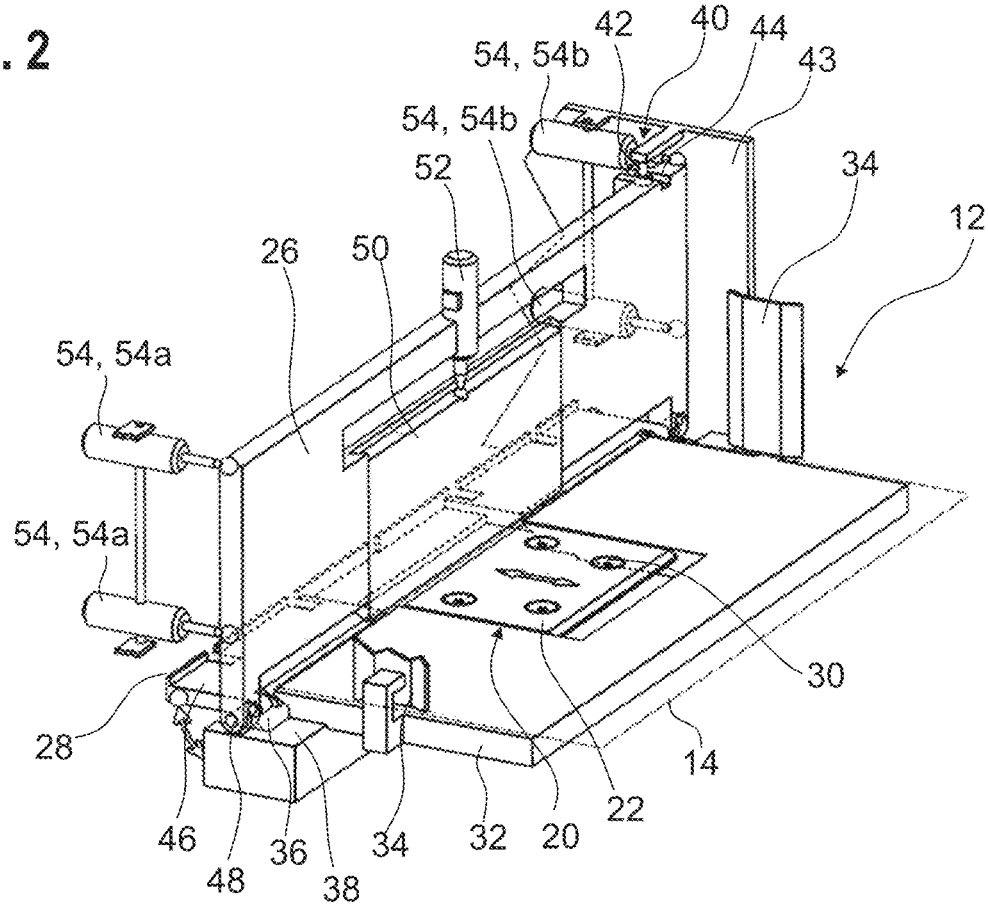
Figure 3:
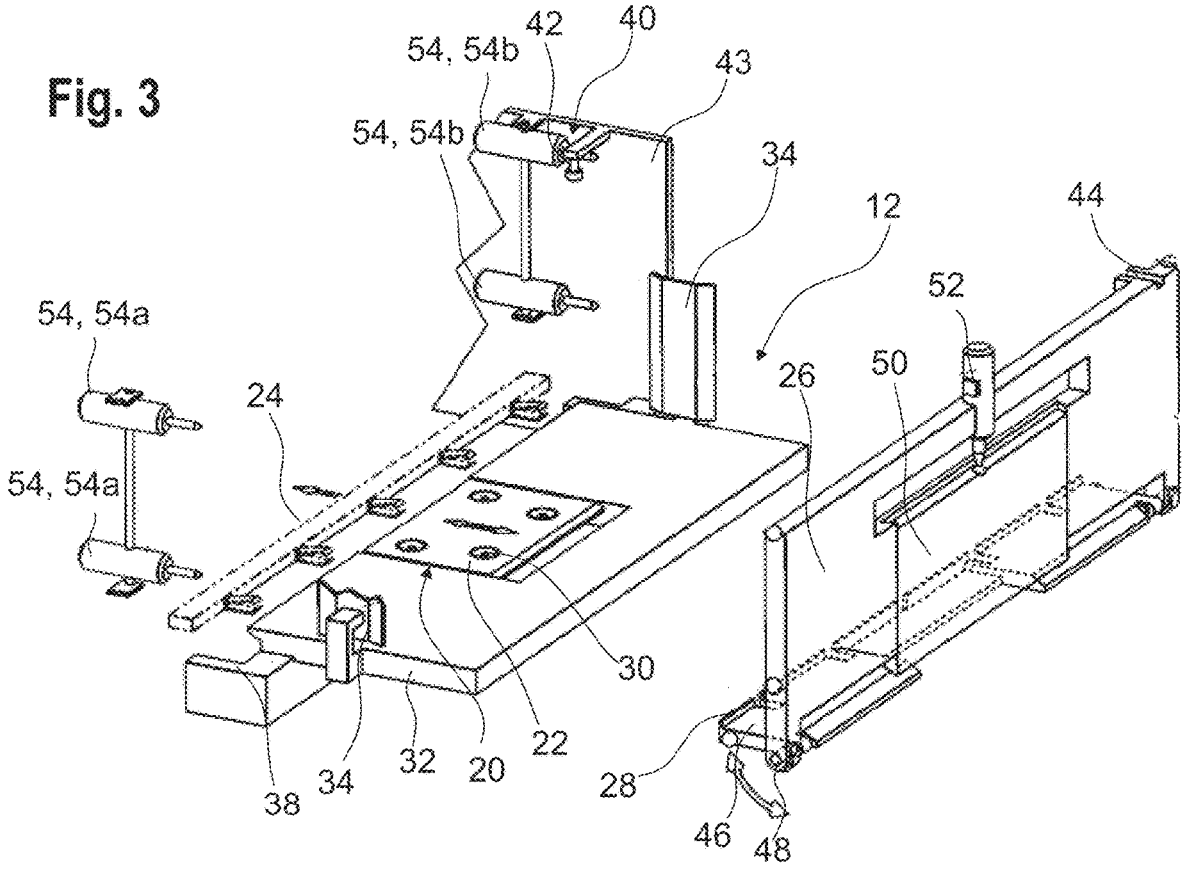
Figure 4:
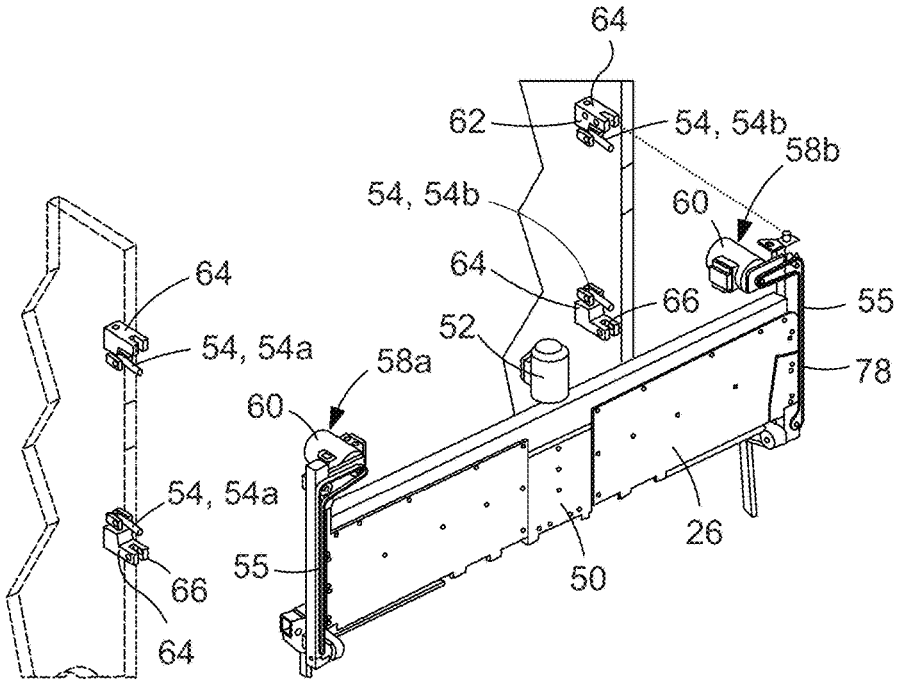
Figure 5:
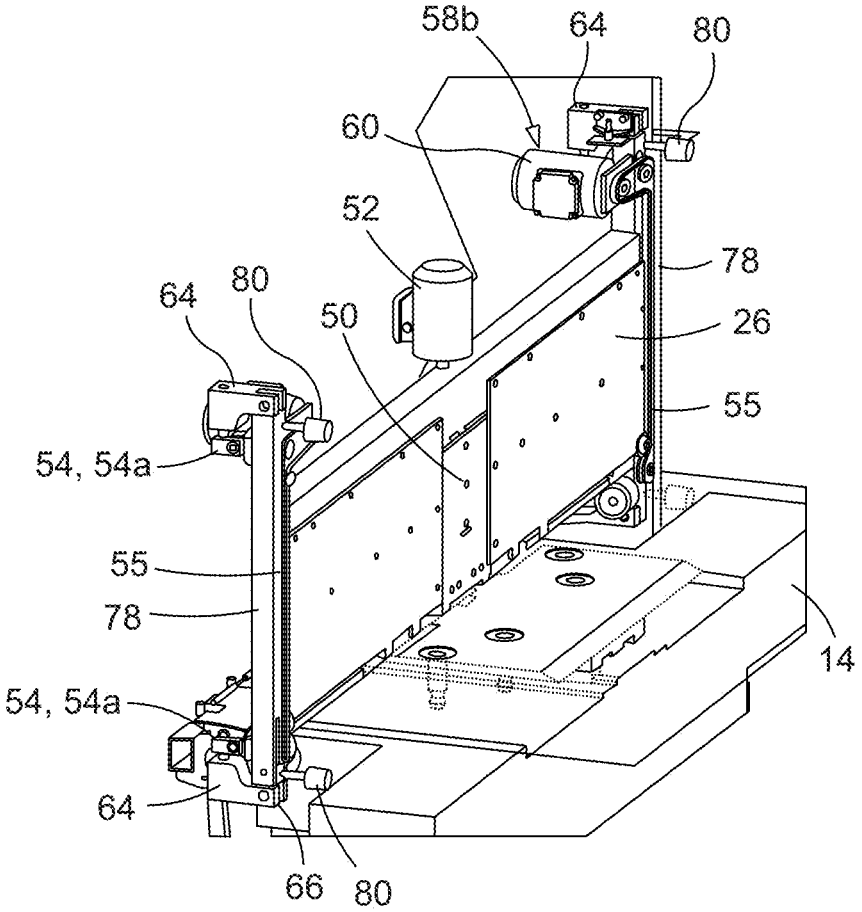
Figure 6:
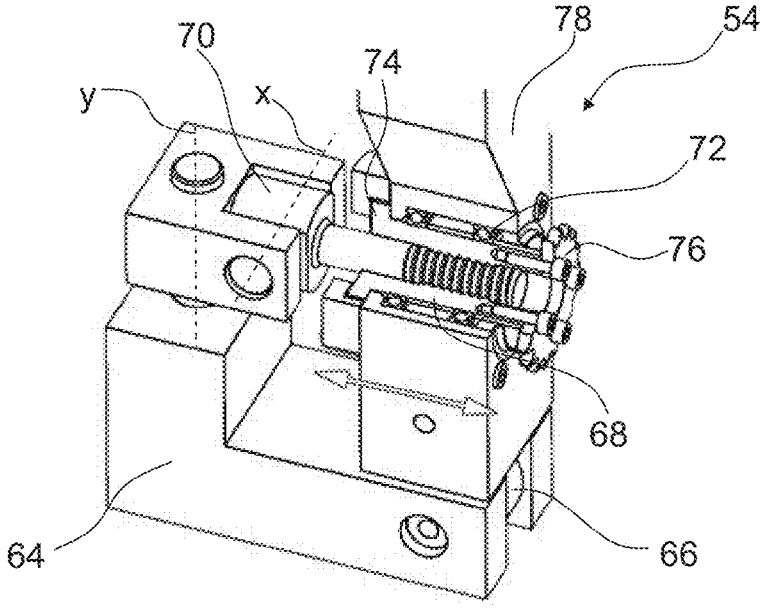
Figure 7:
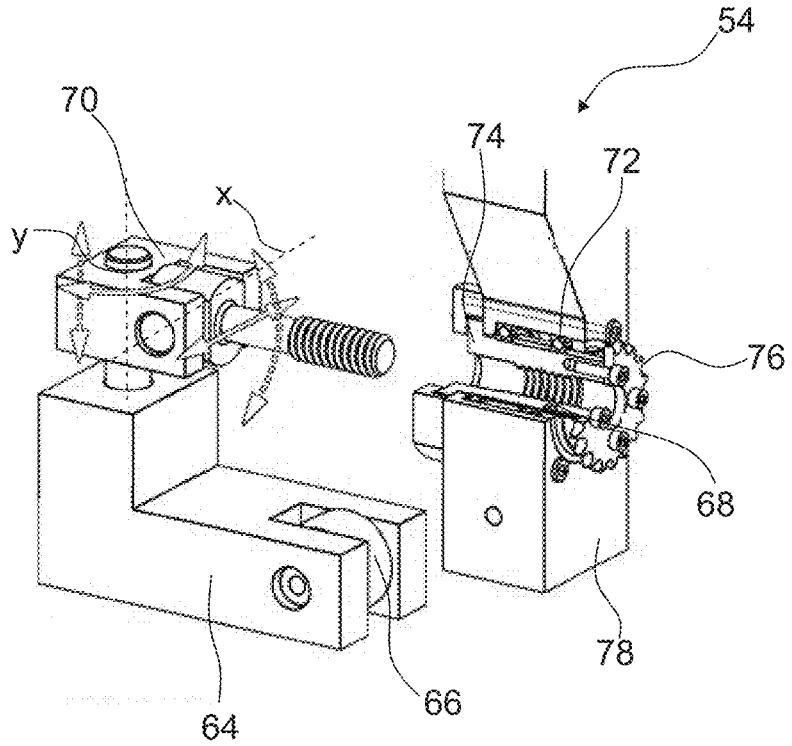
Figure 8:
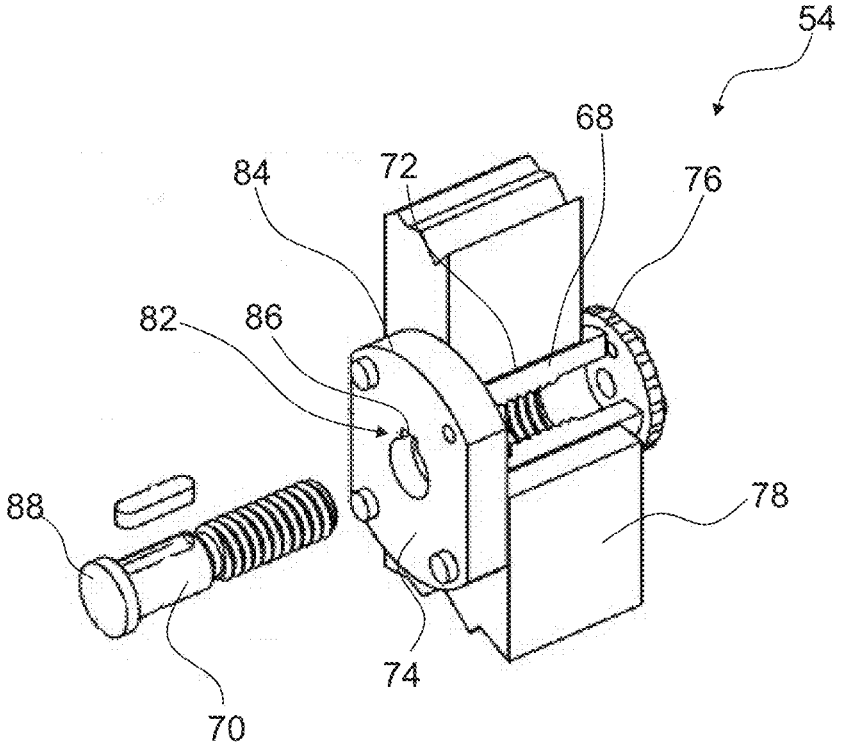
Figure 9:
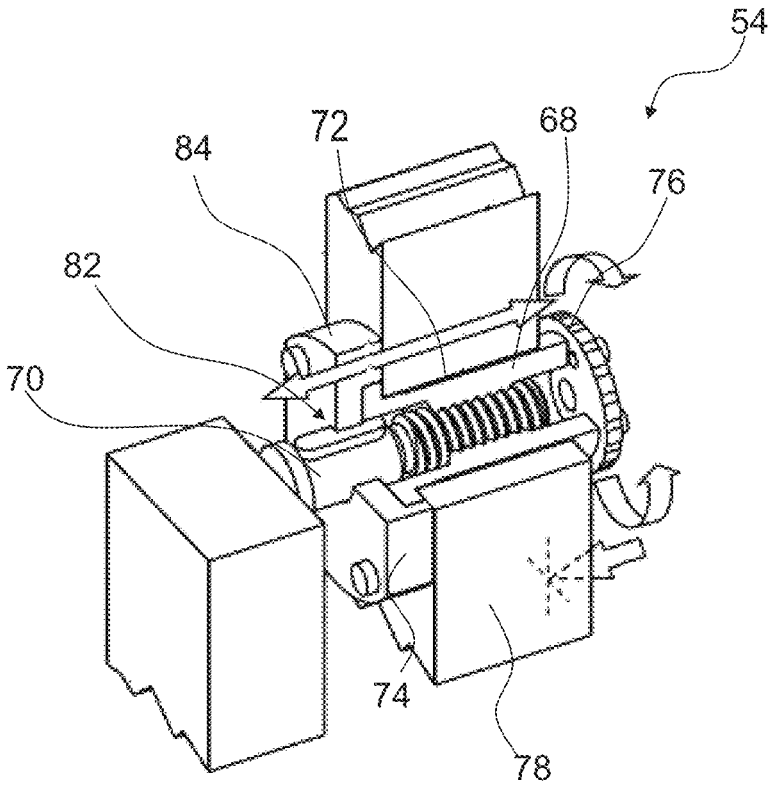
Figure 10:
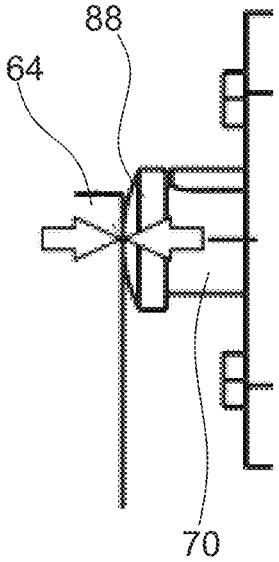
Figure 11:
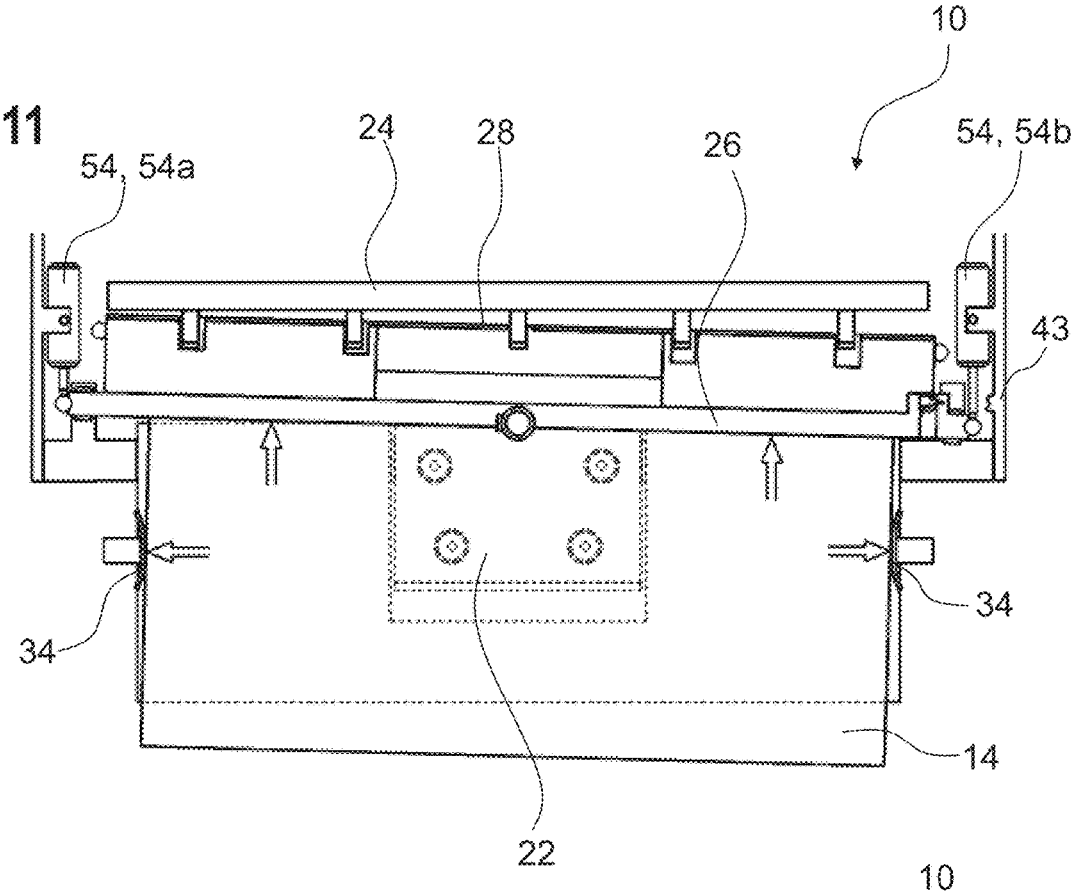
Figure 12:
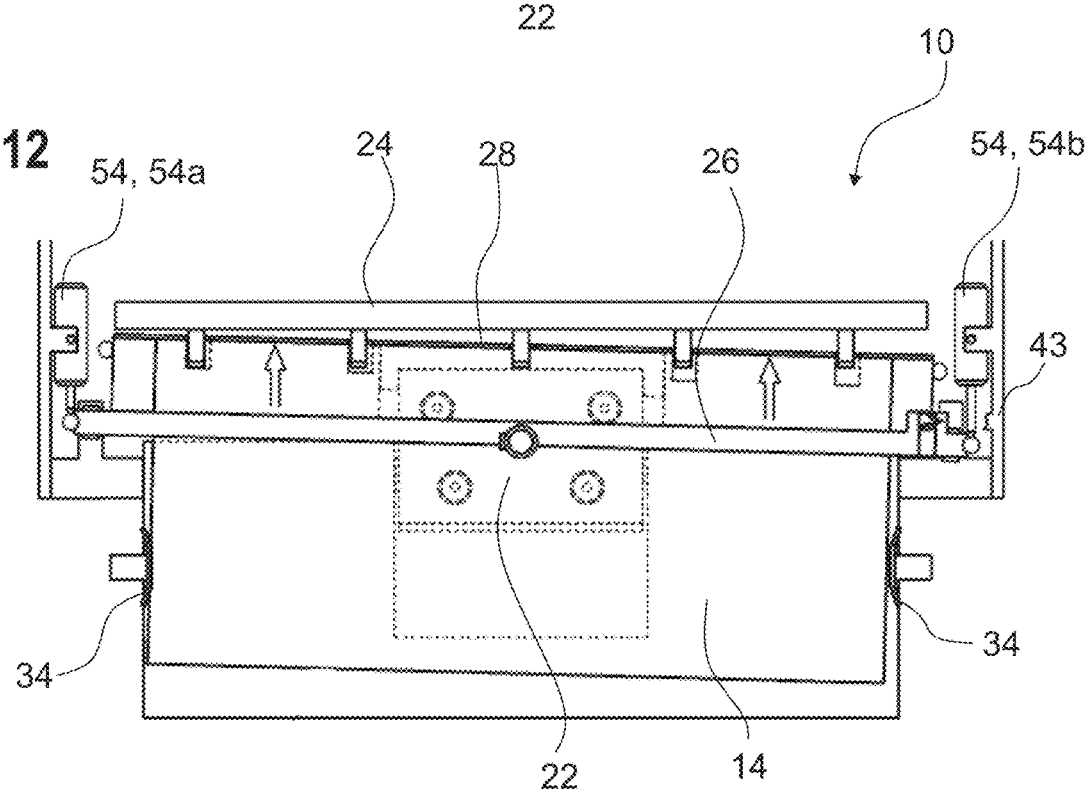
Figure 13:
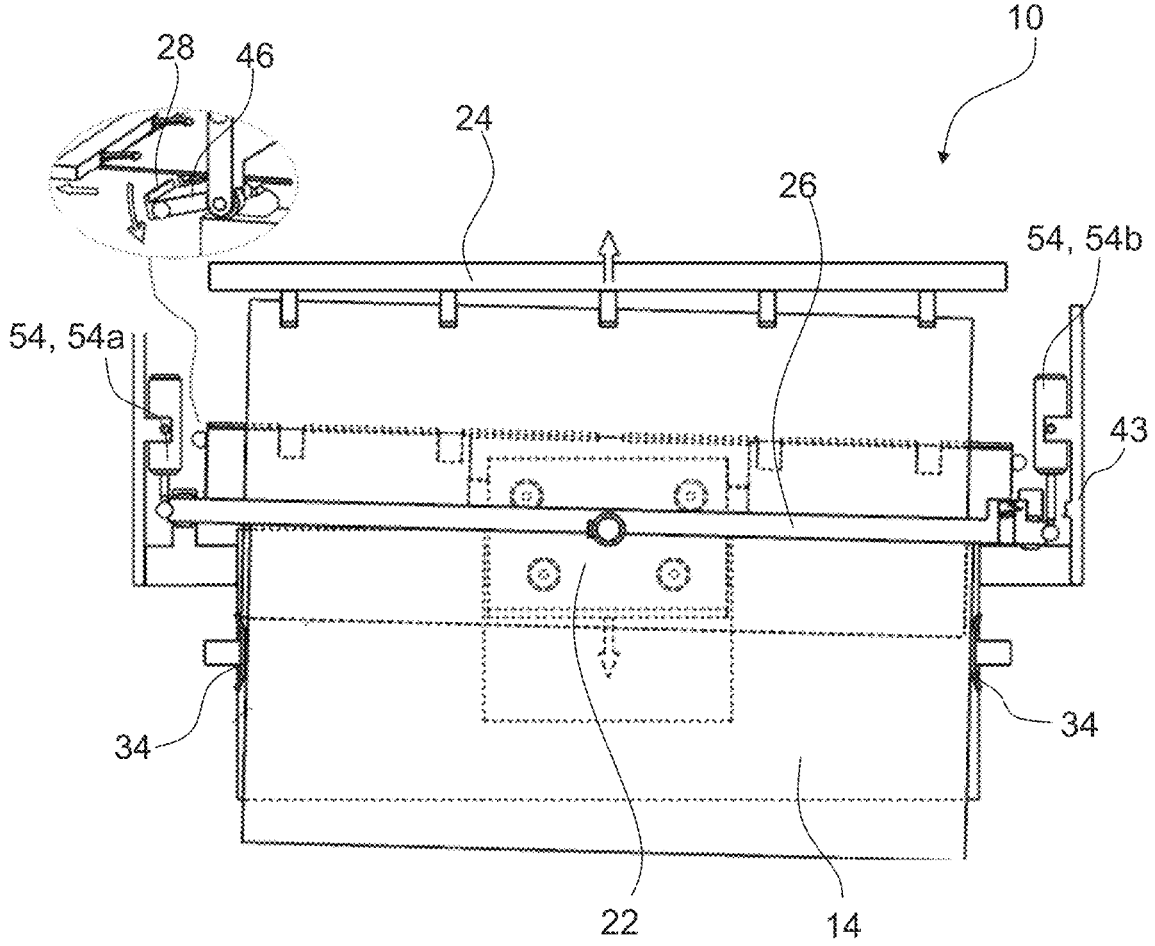
Figure 14:
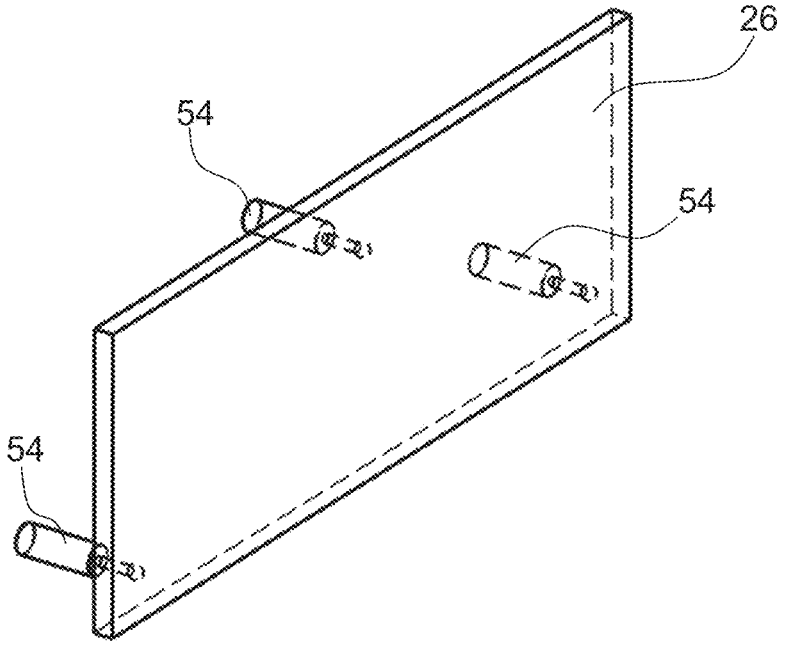
Figure 15:
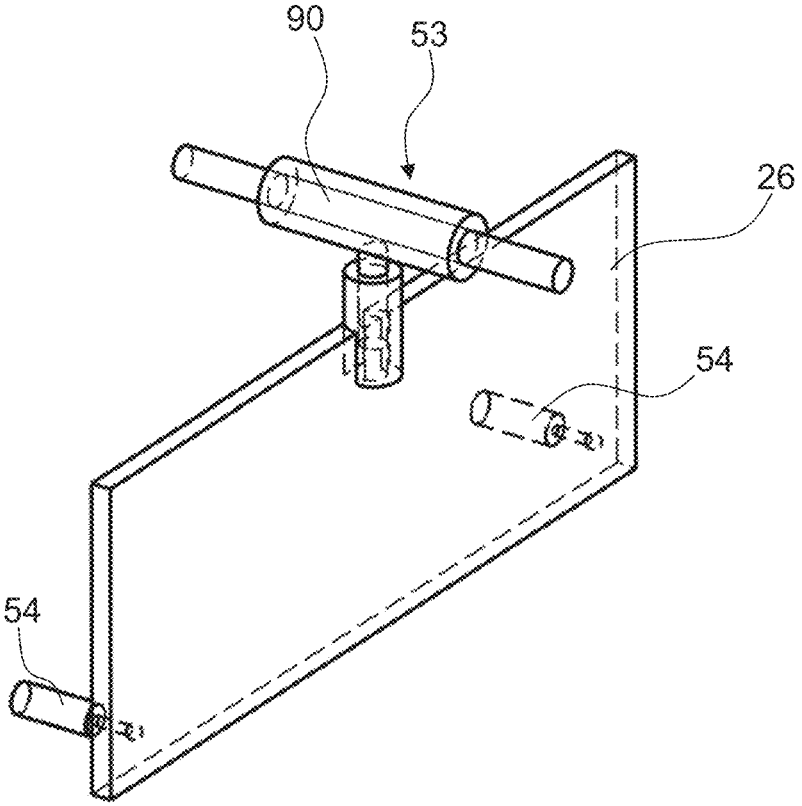

Further features and advantages of the invention become apparent from the following description and the enclosed figures. In the figures:

FIG. 1 shows a sheet processing machine according to the invention in a schematic view, FIG. 2 shows a sub-assembly of an example of the inventive sheet processing machine, FIG. 3 shows the subassembly of FIG. 2 in a partially exploded view, FIG. 4 shows a further subassembly of an example of the inventive sheet processing machine, FIG. 5 shows the subassembly of FIG. 4, FIG. 6 shows a linear actuator for the inventive sheet processing machine, FIG. 7 shows the linear actuator of FIG. 6, FIG. 8 shows an alternative linear actuator for the inventive sheet processing machine, FIG. 9 shows the linear actuator of FIG. 8, FIG. 10 shows an abutment of the linear actuator of FIGS. 8 and 9, FIG. 11 shows the subassembly of FIGS. 2 and 3 in a top view in a first condition, FIG. 12 shows the subassembly of FIGS. 2 and 3 in a second condition, FIG. 13 shows the subassembly of FIGS. 2 and 3 in a further condition, FIG. 14 shows an alternative arrangement of actuators for the inventive sheet processing machine, and FIG. 15 shows a further alternative arrangement of actuators in combination with a guide for the inventive sheet processing machine.

FIG. 1 schematically shows a sheet processing machine 10 in a simplified manner.

With reference to FIG. 1, the general structure and operation of the sheet processing machine 10 according to the invention will be explained.

The sheet processing machine 10 comprises a loading station 12 for supplying sheets 14 to be processed.

The sheet processing machine 10 further comprises a transfer mechanism 16 for moving sheets 14 along a handling direction of the sheet processing machine 10. The handling direction is indicated in FIG. 1 by arrow 18.

Moreover, the sheet processing machine 10 comprises a handling mechanism 20 configured to move a sheet 14 from the sheets 14 piled in the loading station 12 to feed a sheet 14 to the transfer mechanism 16.

Before being fed to the transfer mechanism 16, the sheets 14 must be properly aligned to ensure accurate processing of the sheets 14 in the sheet processing machine 10.

For this purpose, the sheet processing machine 10 has an alignment plate 26 adjoining the loading station 12 for aligning sheets 14 piled in the loading station 12.

The handling mechanism 20 comprises an extraction element 22 for extracting a single sheet 14 from the loading station 12 and optionally an abutment element 28. The abutment element 28 is arranged after the alignment plate 26 with respect to the handling direction. The abutment element 28 is positioned at a fixed distance from the plate 26 and facilitates a repeated alignment of the sheets 14 after removing the sheets 14 form the loading station 12. The abutment mechanism may compensate for a slight imprecision caused by the extraction element 22.

The transfer mechanism 16 comprises a gripper bar 24 configured to grip the sheets 14 provided by the handling mechanism 20. The gripper bar 24 may be driven by two lateral chain drives (not shown) that cycle through the machine. The gripper bar 24 preferably comprises a set of mechanical grippers that grip to the sheet or may comprise a vacuum system to hold on to the sheet.

For operating the sheet processing machine 10, several sheets 14 are piled in the loading station 12.

As shown in FIG. 1, the sheets 14 abut the alignment plate 26 and are thereby pre-aligned.

The extraction element 22 of the handling mechanism 20 extracts a single sheet 14 from the loading station 12, in particular, the bottom sheet 14, and moves it to a gripping position in which the gripper bar 24 may grip the sheet.

The extraction element 22 is for example configured to move back and forth with a fixed motion amplitude.

Preferably, the extraction element 22 travels with a slight over-travel such that the travel of the extraction element 22 is larger than a distance d between an abutment surface the alignment plate 26 and the abutment element 28. Thereby, the sheet is realigned at the abutment element 28 after being extracted from the pile of sheets.

For example, the over-travel is 1.5 mm or less. Thereby, the risk of damaging the sheet 14 upon aligning the sheet 14 at the abutment element 28 is reduced.

When the sheet 14 is in the gripping position, the gripper bar 24 grabs the sheet and feeds it to the processing stations of the machine for further processing.

The alignment plate 26 is moveable in the handling direction, as indicated by arrows in FIG. 1. Thereby, the position of the pile of sheets 14 can be adjusted.

According to the inventive idea, the position of the alignment plate 26 along the handling direction can be set independently for both lateral sides of the alignment plate 26, i.e., for an operator side and an opposite operator side. However, the alignment plate 26 is only allowed to tilt around a vertical axis, but not around a horizontal axis. Thereby, the alignment plate 26 is always in an upright position.

FIGS. 2 and 3 show a subassembly of the sheet processing machine 10 in a more detailed depiction.

The subassembly includes the handling mechanism 20 and the alignment plate 26 as well as the abutment element 28.

In the depicted embodiment, the extraction element 22 of the handling mechanism 20 is a vacuum table having suction areas 30 to grab a sheet 14, which is visualized in FIG. 2 by dashed lines.

The extraction element 22 is integrated into a table 32 on which the sheets 14 are piled.

In the loading station 12, lateral guiding elements 34 are arranged for further improving the alignment of the sheets 14.

The lateral guiding elements 34 are arranged with a distance to the table 32 to allow the bottommost sheet 14 to travel easily when it is extracted from the pile.

The alignment plate 26 comprises sliders 36 at its lower end and rests with the sliders 36 on a supporting surface 38. The supporting surface 38 defines a vertical position of the alignment plate 26.

The sliders 36 can move freely in a horizontal direction.

Furthermore, the alignment plate 26 is guided by a linear guide 40.

The linear guide 40 comprises a guide element 42 that is attached to a machine frame 43 and a corresponding groove 44 in the alignment plate 26.

The abutment element 28 is formed at an edge of a tablet 46 which is mounted at the alignment plate 26. Thereby, there is a fixed distance between the abutment element 28 and the alignment plate 26.

In particular, the tablet 46 is pivotably mounted to the alignment plate 26.

The tablet 46 has the form of an L.

When the tablet 46 is in a supporting position as shown in FIG. 2, the tablet 46 forms an extension of the table 32.

The pivots 48 of the tablet 46 are arranged below a table level on which the sheets 14 are placed.

The alignment plate 26 comprises an integrated gauge plate 50.

The gauge plate 50 is height adjustable with respect to the alignment plate 26, in particular by means of a linear actuator 52.

The gauge plate 50 is configured to set the gap 25 and ensure that only one sheet 14 at a time can be extracted from the pile of sheets in the loading station 12, despite a varying sheet thickness across processing jobs.

The alignment plate 26 is moveable in the handling direction by means of two pairs of linear actuators 54: The pair 54*a* of actuators 54 on the operator side of the machine and the pair 54*b* of actuators 54 on the opposite operator side of the machine. The actuators 54 of each pair 54*a*,54*b* of actuators are arranged vertically one above the other, respectively.

The actuators 54 in FIG. 2 are depicted in a simplified form, but will be described in more detail with reference to FIGS. 6 to 10.

A drive 58*a*, 58*b* of the actuators 54, which will be explained with reference to FIGS. 4 and 5, is configured such that the actuators 54 within each pair 54*a*, 54*b* of actuators are driven synchronously.

By synchronously driving the two actuators 54 of a pair 54*a* of actuators, and by synchronously driving the two actuators 54 of pair 54*b* of actuators, the alignment plate 26 is held in an upright position. Thus, a support mechanism 53 is implemented by means of the specific arrangement of synchronously driven actuators 54.

As shown in FIGS. 4 and 5, the two actuators 54 of each pair 54*a*, 54*b* of actuators are linked by a belt drive or a chain drive 55, respectively.

The actuators 54 within each pair are synchronously driven by a motor 60 which drives the belt drive or chain drive 55.

In an alternative embodiment, which is not shown for reasons of simplicity, each actuator 54 may be driven by a motor 60 and each two motors 60 assigned to a pair of actuators 54 are synchronized, resulting in four motors 60 synchronized in pairs.

The travel distance of the alignment plate 26 may be limited. For this purpose, a sensor 62, in particular a limit switch sensor may be provided.

FIGS. 6 and 7 show a linear actuator 54 according to a first embodiment.

The actuators 54 are attached to blocks 64 that are attached to the machine frame 43.

The blocks 64 which are designated to the lower actuators 54 have a supporting roller 66 to support the actuator 54.

The actuator 54 shown in FIGS. 6 and 7 comprises a threaded drive with a rotatable element 68 and a rotatably fixed element 70 which are in threaded engagement with each other. In the shown embodiment, the rotatably fixed element 70 is a screw and the rotatable element is a threaded shaft.

The rotatably fixed element 70 is fixed to the machine frame 43 and the rotatable element 68 is coupled to the alignment plate 26.

The rotatably fixed element 70 is fixed by means of two perpendicular axes, in particular to the block 64 and thus to the machine frame 43.

One of the axes is a horizontal axis x and one of the axes is a vertical axis y.

The horizontal axis x provides a transversal translation freedom to accommodate with the small transversal movement of a lateral edge of the alignment plate as well as a slight vertical rotation, as indicated by arrows in FIG. 7.

The vertical axis provides a horizontal rotation freedom as well as a vertical play, as also indicated by arrows in FIG. 7.

The rotatable element 68 is supported by means of a bearing 72.

A mechanical play between the rotatable element 68 and the rotatably fixed element is preferably suppressed by applying a constraint between the two elements.

At one end, the rotatable element 68 has a flange 74. The flange 74 is configured to take along the alignment plate 26 when the rotatable element 68 is moved in a direction away from the rotatably fixed element 70.

When the rotatable element 68 is rotated and thus linearly moved along the rotatable fixed element, the flange exerts a force on the alignment plate 26 such that the alignment plate 26 travels with the rotatable element 68. Thereby, a horizontal position of the alignment plate 26 is adjusted.

At the other end, the rotatable element 68 has a pinion 76 which may be integrally formed with the rotatable element 68. By means of the pinion 76 the belt drive or chain drive 55 may be coupled to the rotatable element.

In an alternative embodiment, the position of the rotatable element 68 and the rotatably fixed element 70 may be switched, such that the rotatable element 68 is mounted to the machine frame 43 and the rotatably fixed element 70 is mounted at the alignment plate 26.

As shown in FIGS. 4 and 5, the linear actuators 54 are coupled to the alignment plate 26 by means of rods 78 that are connected to the alignment plate 26.

Close to each actuator 54, an elastic element 80 (see FIG. 5), for example a pusher or a spring, acts on the alignment plate 26, in particular via the rods 78. The elastic elements 80 provide an elastic force for moving the alignment plate 26 with the rotatable element 68 when the rotatable element 68 is moved in a direction towards the rotatably fixed element 70.

FIGS. 8 to 10 show a linear actuator 54 according to a further embodiment. Compared to the actuator 54 shown in FIGS. 6 and 7, the actuator 54 has a simplified design.

In this embodiment, the rotatably fixed element 70 is fixed by means of a key and groove connection 82.

Also, the bearing 72 of the rotatable element 68 is simplified. In particular, the bearing 72 is a cylindrical plain bearing.

The flange 74 is implemented by means of a cover 84 which comprises a groove 86 for the key and groove connection 82.

One end of the rotatably fixed element 70, in particular a screw head 88 of the rotatably fixed element 70 abuts the static block 64 fixed to the machine frame 43.

The elastic elements 80, which are not show in FIGS. 8 to 10, urge the linear actuator 54 against the block 64 such that the rotatably fixed element 70 stays in contact with the static block 64. Thereby, a precise reference is maintained.

It is thinkable that the amount of force is lowered during the longitudinal setting of the alignment plate 26 to reduce wear.

As shown in FIG. 10, the contact surface of the rotatably fixed element 70 with the block 64 is spherical to allow angular play.

FIGS. 11 to 13 further illustrate the operation of the inventive sheet processing machine 10.

In FIGS. 11 to 13, the alignment plate 26 is depicted with a skewing angle which is exaggerated in the Figures for exemplification.

The skewing angle can be adjusted by operating the pair of actuators 54*a* independently from the pair of actuators 54*b*, in particular with different numbers of revolutions.

FIG. 11 shows the sheet processing machine 10 in a condition where a sheet 14 is placed in the loading station 12 and is in abutment with the alignment plate 26.

The extraction element 22 of the handling mechanism 20 is in a position below the sheet 14 for picking up the bottommost sheet 14 of a pile.

FIG. 12 shows a condition of the sheet processing machine 10 in which the extraction element 22 has traveled to a supplying position, wherein upon traveling the extraction element 22 has extracted the bottommost sheet 14 from the pile.

In this condition, the sheet 14 abuts the abutment element 28 to be realigned.

When the sheet 14 is in the position as shown in FIG. 12, the gripper bar 24 is able to grip the sheet 14 and transport the sheet through the processing stations of the machine.

To enable the gripper bar 24 to pull the sheet towards the transfer mechanism 16, the tablet 46 is pivoted such that the abutment element 28 is lowered and a travel path of the sheet 14 is cleared (see FIG. 13).

FIG. 14 illustrate an alternative drive for the alignment plate 26 that can be integrated in the sheet processing machine 10 which has been described with reference to FIGS. 1 to 13.

The embodiment according to FIG. 14 differs from the embodiment described in accordance to FIGS. 1 to 13 in the arrangement of the actuators 54. In particular, the alignment plate 26 is moveable along a handling direction by means of three actuators 54.

The actuators 54 are arranged with a distance to each other in a direction transverse to a handling direction of the sheet processing machine 10.

One actuator 54 is arranged close to an operator side of the alignment plate 26 and the other actuator 54 is arranged close to an opposite operator side, i. e with a distance of less than 20 cm, in particular less than 10 cm to the operator side respectively the opposite operator side.

The two actuators 54 are arranged at the same vertical position.

A third actuator 54 is arranged between the two actuators at the operator side and the opposite operator side, in particular on a vertical center line of the alignment plate 26.

The third actuator 54 is arranged at a different height than the other two actuators 54.

The third actuator 54 supports the alignment plate 26 in such a way that tilting of the alignment plate 26 around a horizontal axis upon movement of the alignment plate 26 is prevented. Thus, by means of the third actuator 54, the support mechanism 53 is realized.

A turning rate of the third actuator 54 while moving the alignment plate 26 is for example adapted to the turning rate of the further actuators 54 to prevent tilting of the alignment plate around a horizontal axis. FIG. 15 illustrates an alternative drive for the alignment plate 26 which is in accordance with the invention.

Instead of a third actuator 54 that is arranged on a vertical center line of the alignment plate 26, the drive comprises a rail 90 that maintains an upright position of the alignment plate 26.

The invention claimed is:

1. A sheet processing machine comprising:

a transfer mechanism for moving sheets along a handling direction of the sheet processing machine, a loading station for supplying sheets to be processed, an alignment plate adjoining the loading station for aligning sheets piled in the loading station at a table level, and a handling mechanism for extracting the bottommost sheet from the pile of sheets, moving it through a gap between the table level and the bottom of the alignment plate and handing it over to the transfer mechanism, wherein the alignment plate is moveable in the handling direction by means of at least two linear actuators which are arranged at a distance to each other along a direction transverse to the handling direction, wherein a support mechanism is provided that prevents the alignment plate from pivoting around a horizontal axis, and wherein the sheet processing machine comprises an abutment element which is arranged after the alignment plate and at a fixed distance from the alignment plate with respect to the handling direction for fine adjustment of a sheet.

2. The sheet processing machine according to claim 1, wherein the alignment plate is moveable by means of two pairs of linear actuators, wherein the actuators within each pair of actuators are arranged vertically one above the other, and wherein a drive of the pair of actuators is configured such that the actuators within each pair of actuators are driven synchronously.

3. A sheet processing machine comprising:

a transfer mechanism for moving sheets along a handling direction of the sheet processing machine, a loading station for supplying sheets to be processed, an alignment plate adjoining the loading station for aligning sheets piled in the loading station at a table level, and a handling mechanism for extracting the bottommost sheet from the pile of sheets, moving it through a gap between the table level and the bottom of the alignment plate and handing it over to the transfer mechanism, wherein the alignment plate is moveable in the handling direction by means of at least two linear actuators which are arranged at a distance to each other along a direction transverse to the handling direction, wherein a support mechanism is provided that prevents the alignment plate from pivoting around a horizontal axis, and wherein each actuator of the at least two linear actuators comprise a threaded drive with a rotatable element and a rotatably fixed element which are in threaded engagement with each other.

4. The sheet processing machine according to claim 3, wherein the rotatably fixed element is fixed by means of two perpendicular axes, in particular to a machine frame.

5. The sheet processing machine according to claim 3, wherein the rotatably fixed element is fixed by means of a key and groove connection.

6. The sheet processing machine according to claim 3, wherein the at least two linear actuators are driven by a single motor and the rotatable elements of the at least two linear actuators are linked by a belt drive or a chain drive.

7. The sheet processing machine according to claim 3, wherein the rotatable element of each actuator of the at least two linear actuators is driven by a motor and the two motors assigned to the at least two linear actuators are synchronized.

8. The sheet processing machine according to claim 1, wherein the alignment plate comprises sliders at its lower end and rests with the sliders on a supporting surface.

9. The sheet processing machine according to claim 1, wherein a travel distance of the alignment plate is limited.

10. The sheet processing machine according to claim 1, wherein the alignment plate is guided by at least one linear guide.

11. The sheet processing machine according to claim 1, wherein the abutment element is formed at an edge of a tablet which is mounted at the alignment plate.

12. The sheet processing machine according to claim 11, wherein the tablet is pivotably mounted to the alignment plate and the pivots are arranged below the table level on which the sheets are placed.

13. The sheet processing machine according to claim 11, wherein the tablet has the form of an L.

14. The sheet processing machine according to claim 1, wherein the alignment plate comprises a gauge plate that is height adjustable with respect to the alignment plate for setting the gap.

15. The sheet processing machine according to claim 1, wherein the sheet processing machine comprises a handling mechanism configured to move a sheet from the sheets piled in the loading station to feed a sheet to the transfer mechanism.

* * * * *